US010591191B2

(12) United States Patent
Christians et al.

(10) Patent No.: US 10,591,191 B2
(45) Date of Patent: Mar. 17, 2020

(54) REFRIGERANT RISER FOR EVAPORATOR

(71) Applicant: Carrier Corporation, Farmington, CT (US)

(72) Inventors: Marcel Christians, Skaneateles, NY (US); Jack Leon Esformes, Jamesville, NY (US); Satyam Bendapudi, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 237 days.

(21) Appl. No.: 15/104,842

(22) PCT Filed: Oct. 22, 2014

(86) PCT No.: PCT/US2014/061708
§ 371 (c)(1),
(2) Date: Jun. 15, 2016

(87) PCT Pub. No.: WO2015/099873
PCT Pub. Date: Jul. 2, 2015

(65) Prior Publication Data

US 2016/0313035 A1 Oct. 27, 2016

Related U.S. Application Data

(60) Provisional application No. 61/920,518, filed on Dec. 24, 2013.

(51) Int. Cl.
*F25B 39/00* (2006.01)
*F24F 5/00* (2006.01)
(Continued)

(52) U.S. Cl.
CPC ..... *F25B 39/00* (2013.01); *F24F 5/001* (2013.01); *F25B 41/00* (2013.01); *F25B 41/062* (2013.01);
(Continued)

(58) Field of Classification Search
CPC ..... F25B 39/028; F25B 41/003
See application file for complete search history.

(56) References Cited

U.S. PATENT DOCUMENTS 2,103,722 A * 12/1937 Hibberd ..... F25B 1/06 62/100
5,375,428 A 12/1994 Leclear et al.
(Continued)

FOREIGN PATENT DOCUMENTS

CN 1343295 A 4/2002
CN 1934394 A 3/2007
(Continued)

OTHER PUBLICATIONS

Notification of Transmittal of the International Search Report and the Written Opinion of the International Searching Authority, or the Declaration; Application No. PCT/US2014/061708; dated Jan. 22, 2015; 11 pages.
(Continued)

*Primary Examiner* — Elizabeth J Martin
*Assistant Examiner* — Melodee Jefferson
(74) *Attorney, Agent, or Firm* — Cantor Colburn LLP

(57) ABSTRACT

A heating, ventilation and air conditioning (HVAC) system includes a condenser (18) flowing a flow of refrigerant therethrough and to an output pipe (56) and a falling film evaporator (12) in flow communication with the condenser and having an evaporator input pipe (58) located vertically higher than the output pipe. A plurality of riser pipes (60) connect the output pipe to the evaporator input pipe. The flow of refrigerant flows through selected riser pipes of the plurality of riser pipes as required by a load on the HVAC system.

10 Claims, 4 Drawing Sheets

(51) Int. Cl.

| | |
|---|---|
| ***F25B 41/00*** | (2006.01) |
| ***F25B 41/06*** | (2006.01) |
| ***F28D 3/02*** | (2006.01) |
| ***F28D 21/00*** | (2006.01) |
| ***F25B 39/02*** | (2006.01) |

(52) U.S. Cl.
CPC ..... *F28D 3/02* (2013.01); *F28D 21/0017* (2013.01); *F25B 39/028* (2013.01); *F25B 2339/021* (2013.01); *F25B 2339/0242* (2013.01)

(56) References Cited

U.S. PATENT DOCUMENTS 6,167,713 B1 * 1/2001 Hartfield ..... F25B 39/028 165/160
2009/0178790 A1 * 7/2009 Schreiber ..... F25B 39/028 165/158
2013/0277019 A1 11/2013 Numata et al.

FOREIGN PATENT DOCUMENTS

CN 102187165 A 9/2011
CN 102812313 A 12/2012
JP 2007271181 A 10/2007
WO WO 2011083129 A2 * 7/2011 ..... F25B 41/062

OTHER PUBLICATIONS

Chinese Office Action Issued in CN Application No. 201480070850.7, dated Apr. 16, 2018, 8 Pages.
Chinese Office Action Issued in CN Application No. 201480070850.7, dated Dec. 12, 2018, 10 Pages.

* cited by examiner

REFRIGERANT RISER FOR EVAPORATOR

BACKGROUND

The subject matter disclosed herein relates to heating, ventilation and air conditioning (HVAC) systems. More specifically, the subject matter disclosed herein relates to HVAC systems with falling film evaporators utilizing low or medium pressure refrigerants.

HVAC systems, such as chillers, use an evaporator to facilitate a thermal energy exchange between a refrigerant in the evaporator and a medium flowing in a number of evaporator tubes positioned in the evaporator. In systems with flooded evaporators, the tubes are submerged in a pool of refrigerant. In flooded evaporator systems, the evaporator and condenser are located substantially side-by-side. In a single stage system, liquid refrigerant leaving the condenser will go through a metering device, such as an expansion valve, and a two phase mixture of liquid and vapor refrigerant enters the evaporator from the bottom of the evaporator. In a two stage system including an economizer, after passing through the metering device the liquid and vapor refrigerant mixture flows through the economizer where the liquid refrigerant is metered again, with a second liquid and vapor refrigerant mixture flowing into the bottom of the evaporator.

In a falling film evaporator system, the liquid refrigerant is fed in through the top of the evaporator and falls over the tubes, where it is evaporated. In a stacked arrangement of a falling film system, the condenser is installed on top of the economizer, which is installed on top of the evaporator. In this system, the flow through the components is driven by gravity. If the condenser and evaporator are arranged side-by-side, however, with an evaporator inlet physically higher than the exit of the metering device downstream of the condenser or economizer, the two-phase refrigerant mixture will have to be routed through a two-phase riser into the evaporator.

Traditionally, when using either medium pressure or high pressure refrigerants, the vertical pipe of the riser is sized such that for all flow conditions (lift and flow rate) the mixture's momentum is great enough to ensure constant flow rate into the evaporator. This sizing results in very large frictional pressure drops at large flow rates. This is not an issue with the high pressure refrigerants, however, since the pressure differential due to lift in these refrigerants can accommodate the frictional pressure drops. When using low pressure refrigerants in falling film applications, however, the pressure differential due to lift is about 25% of that of a typical medium pressure refrigerant, severely limiting the frictional pressure allowed while still maintaining control of flow through the system using the metering device.

BRIEF SUMMARY

In one embodiment, a heating, ventilation and air conditioning (HVAC) system includes a condenser flowing a flow of refrigerant therethrough and to an output pipe and a falling film evaporator in flow communication with the condenser and having an evaporator input pipe located vertically higher than the output pipe. A plurality of riser pipes connects the output pipe to the evaporator input pipe. The flow of refrigerant flows through selected riser pipes of the plurality of riser pipes as required by a load on the HVAC system.

In another embodiment, a method of operating a heating, ventilation and air conditioning (HVAC) system includes urging a flow of refrigerant from a condenser into an output pipe. The flow or refrigerant is directed through a select number of riser pipes of a plurality of riser pipes vertically upwardly toward a evaporator input pipe disposed vertically higher than the output pipe. The flow of refrigerant is urged through the evaporator input pipe and into an evaporator.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
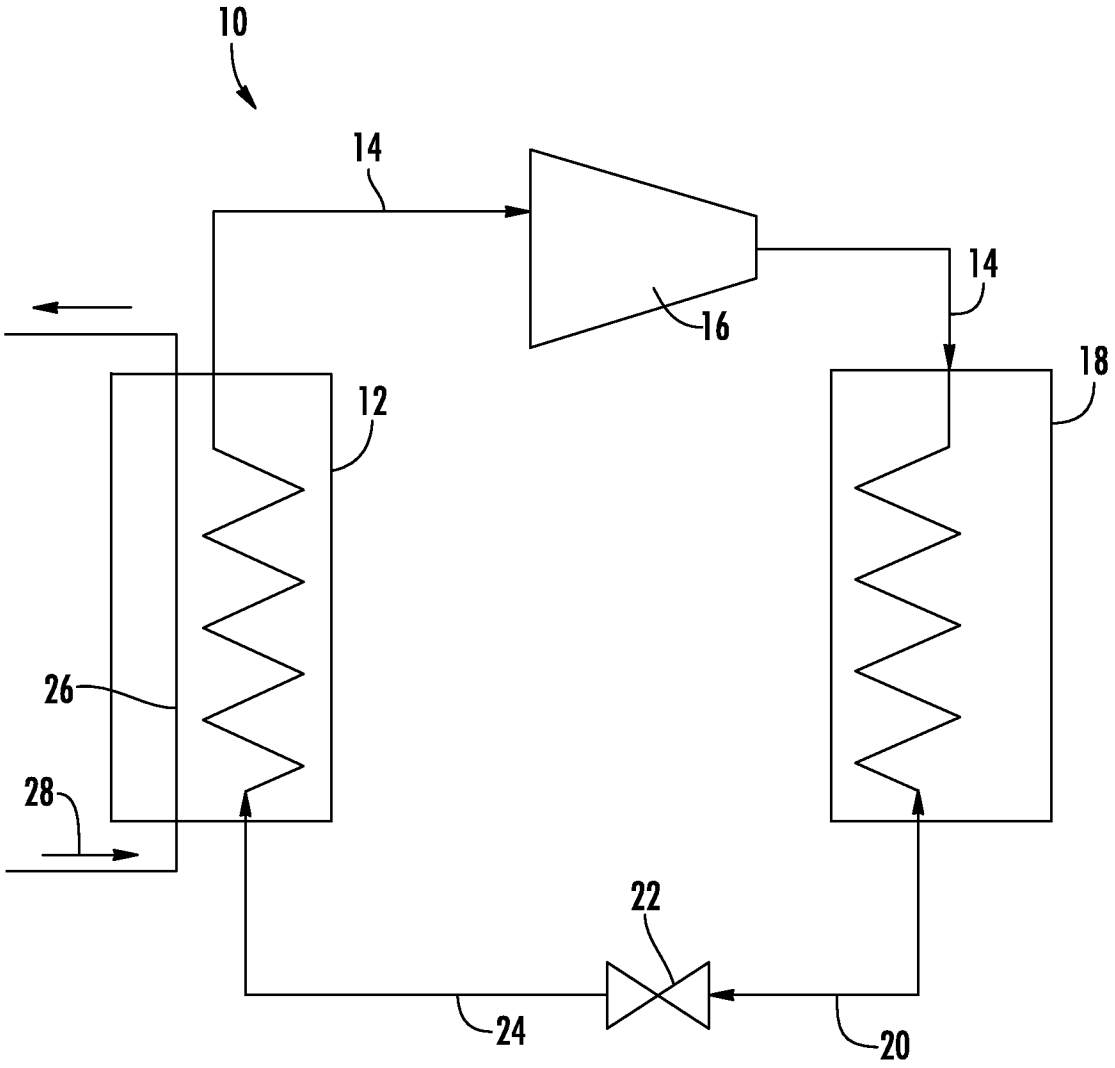
FIG. 1 is a schematic view of an embodiment of a heating, ventilation and air conditioning (HVAC) system.

The detailed description explains embodiments of the invention, together with advantages and features, by way of example with reference to the drawing.

DETAILED DESCRIPTION

Shown in FIG. 1 is a schematic view of an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
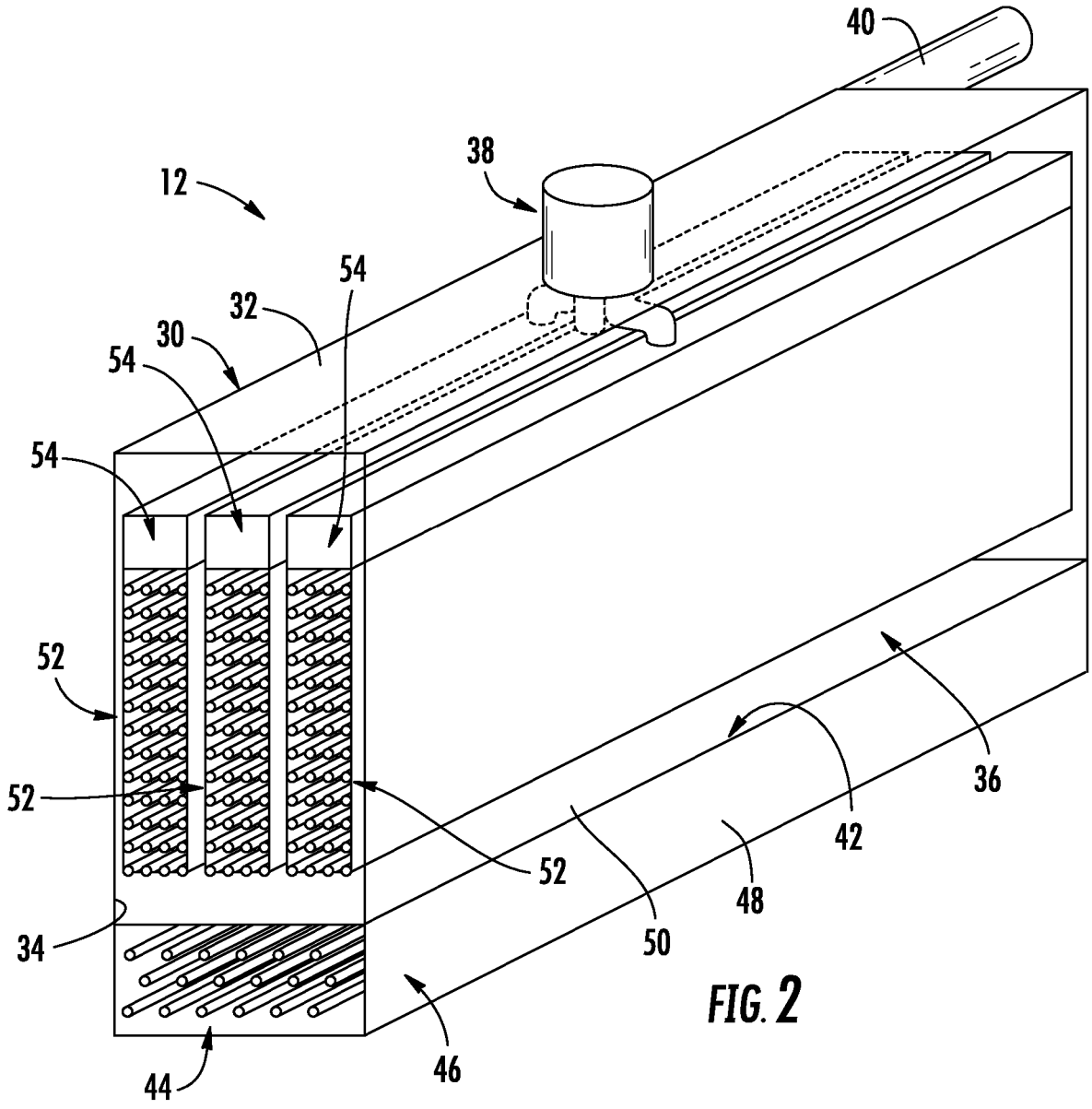
FIG. 2 is a schematic view of an embodiment of an evaporator for an HVAC system.

Referring now to FIG. 2, as stated above, the evaporator 12 is a falling film evaporator. The evaporator 12 includes a shell 30 having an outer surface 32 and an inner surface 34 that define a heat exchange zone 36. As shown, shell 30 includes a rectangular cross-section however, it should be understood that shell 30 can take on a variety of forms including both circular and non-circular. Shell 30 includes a refrigerant inlet 38 that is configured to receive a source of refrigerant (not shown). Shell 30 also includes a vapor outlet 40 that is configured to connect to an external device such as the compressor 16. Evaporator 12 is also shown to include a refrigerant pool zone 42 arranged in a lower portion of shell 30. Refrigerant pool zone 14 includes a pool tube bundle 44 that circulates a fluid through a pool of refrigerant 46. Pool of refrigerant 46 includes an amount of liquid refrigerant 48 having an upper surface 50. The fluid circulating through the pool tube bundle 44 exchanges heat with pool of refrigerant 46 to convert the amount of refrigerant 48 from a liquid to a vapor state. In some embodiments, the refrigerant may be a "low pressure refrigerant" defined as a refrigerant having a liquid phase saturation pressure below about 45 psi (310.3 kPa) at 104° F. (40° C.). An example of low pressure refrigerant includes R245fa.

In accordance with the exemplary embodiment shown, evaporator 12 includes a plurality of tube bundles 52 that provide a heat exchange interface between refrigerant and another fluid. Each tube bundle 52 may include a corresponding refrigerant distributor 54. Refrigerant distributors 54 provide a uniform distribution of refrigerant onto tube bundles 52 respectively. As will become more fully evident below, refrigerant distributors 54 deliver a refrigerant onto the corresponding ones of tube bundles 52.

Figure 3:
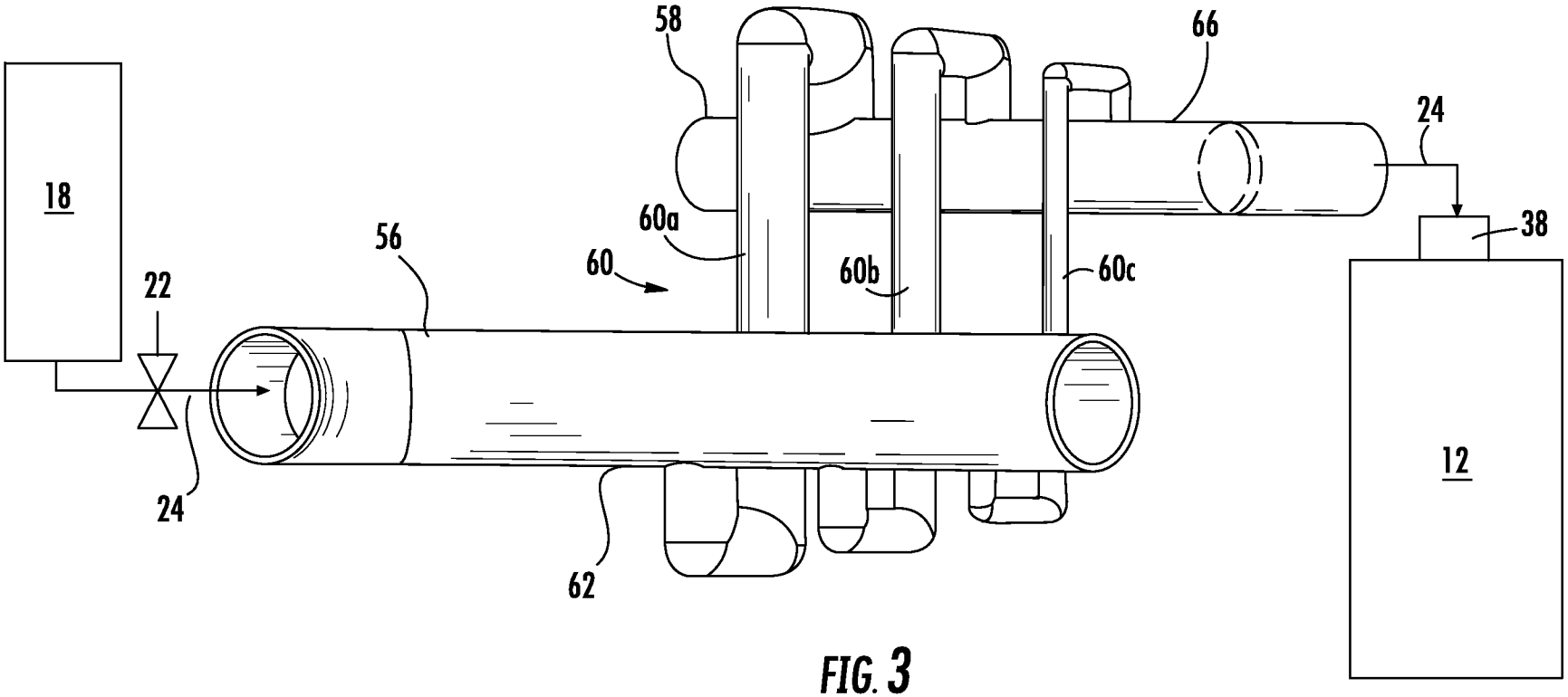
FIG. 3 is a schematic view of an embodiment of a riser pipe configuration for an HVAC system.

Referring now to FIG. 3, the chiller 10 is arranged such that an output pipe 56 downstream from the expansion valve 22, is physically lower than an evaporator input pipe 58. It is to be appreciated that while a single-stage system in shown in FIG. 3, the subject matter of this disclosure may be readily applied to multi-stage systems including an economizer. In such systems, the output pipe 56 is downstream of a low stage expansion valve at the economizer, or at an intermediate stage expansion device in systems of three or more stages. An array of riser pipes 60 connect the output pipe 56 to the evaporator input pipe 58 so that the liquid and vapor refrigerant mixture 24 is flowed to the evaporator 12 and over the tube bundles 52 via distributor 54 (shown in FIG. 2). Three riser pipes 60 are shown in the embodiment of FIG. 3, but it is to be appreciated that any number of two or more riser pipes 60 is contemplated within the present disclosure. There is no analytical maximum limit, but practically, increasing the number of riser pipes 60 increases complexity of the assembly.

As shown, the riser pipes 60 have different cross-sectional areas, with large riser pipe 60*a* having the largest, small riser pipe 60*c* having the smallest, and medium riser pipe 60*b* having a cross-sectional area between that of large riser pipe 60*a* and small riser pipe 60*c*. In the embodiment shown, large riser pipe 60*a* is closest to the expansion valve 22 and the small riser pipe 60*c* is furthest from the expansion valve 22, but other arrangements of the riser pipes 60 are contemplated in the present disclosure.

Figure 4:
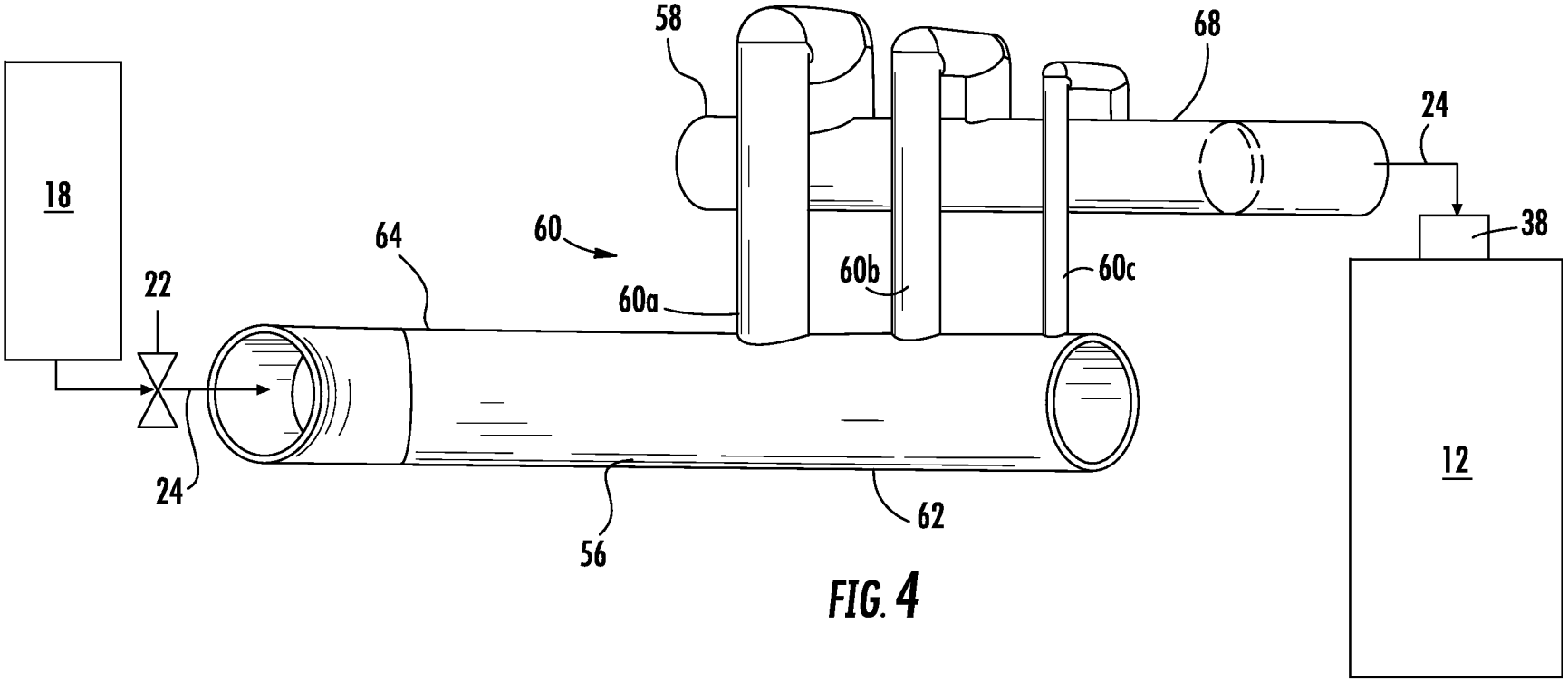
FIG. 4 is a schematic view of another embodiment of a riser pipe configuration for an HVAC system.

The riser pipes 60 are connected to the output pipe 56 at a condenser output pipe bottom 62. This reduces refrigerant charge necessary, especially during part power operation, as the output pipe 56 will still deliver refrigerant to the riser pipes 60 without needing to completely fill the output pipe 56. It is to be appreciated, however, that alternate arrangements are contemplated within the scope of the present disclosure, such as that shown in FIG. 4, where the riser pipes 60 are connected to an output pipe top 64. Such embodiments require completely filling the output pipe 56, but the length of piping utilized for the riser pipes 60 can be decreased. Thus, the length of pipe subjected to two-phase frictional pressure drop is reduced. Referring again to FIG. 3, the riser pipes 60 are connected to the evaporator input pipe 58 at an evaporator input pipe top 66, so that in part load conditions, refrigerant does not flow back from the evaporator input pipe 58 through the riser pipes 60 and into the output pipe 56.

Under full load, all three riser pipes 60*a*-60*c* are utilized to flow the vapor and liquid refrigerant mixture 24 to the evaporator input pipe 58. As load decreases, riser pipes 60 are deactivated, beginning with the large riser pipe 60*a*. This deactivation of riser pipes 60 happens automatically, and outside input is not required. The vapor and liquid refrigerant mixture 24 automatically selects which riser pipes 60 to flow through as there is a fixed pressure differential between the evaporator 12 and the condenser 18. Because of this fixed pressure differential, the required pressure drop is also fixed and the flow rates of the vapor and liquid refrigerant mixture 24 will balance automatically to achieve the pressure differential.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a condenser flowing a flow of refrigerant therethrough;

an expansion device disposed downstream of the condenser such that the flow of refrigerant output from the condenser flows through the expansion device;

an output pipe disposed directly downstream of the expansion device such that the flow of refrigerant output from the expansion device directly flows into the output pipe;

a falling film evaporator in flow communication with the condenser and having an evaporator input pipe disposed vertically higher than the output pipe; and a plurality of riser pipes, each riser pipe of the plurality of riser pipes including:

a first riser pipe end connected to and extending from the output pipe; and a second riser pipe end opposite the first riser pipe end connected to and extending from the evaporator input pipe;

wherein the flow of refrigerant selectably flows through one or more selected riser pipes of the plurality of riser pipes from the output pipe to the input pipe as required by a load on the HVAC system.

2. The HVAC system of claim 1, wherein a first riser pipe of the plurality of riser pipes has a different cross-sectional area than a second riser pipe of the plurality of riser pipes.

3. The HVAC system of claim 2, wherein as system load decreases, refrigerant flow through the riser pipes of the plurality of riser pipes with the greatest cross-sectional area is stopped.

4. The HVAC system of claim 1, wherein the plurality of riser pipes connect to the output pipe at a bottom of the output pipe.

5. The HVAC system of claim 1, wherein the plurality of riser pipes is three riser pipes, each riser pipe having a different cross-sectional area.

6. The HVAC system of claim 1, wherein the plurality of riser pipes connect to the evaporator input pipe at a top of the evaporator input pipe.

7. The HVAC system of claim 1, wherein the evaporator input pipe extends into a top of the evaporator.

8. The HVAC system of claim 1, wherein the refrigerant flows through all of the riser pipes of the plurality of riser pipes at full system load.

9. The HVAC system of claim 1, wherein the refrigerant flows through fewer than all of the riser pipes at part system load conditions.

10. The HVAC system of claim 1, wherein the flow of refrigerant is a low pressure refrigerant.

* * * * *